United States Patent [19]

Tetsuka et al.

[11] 4,062,539

[45] Dec. 13, 1977

[54] AUTOMATIC CONTROL SYSTEMS FOR RIPPERS FOR USE IN CIVIL WORKS

[75] Inventors: Iwao Tetsuka; Kusuo Kato; Yasuyuki Takahashi; Tomoharu Sano, all of Hirakata, Japan

[73] Assignee: Kabushiki Kaisha Komatsu Seisakusho, Tokyo, Japan

[21] Appl. No.: 700,519

[22] Filed: June 28, 1976

[30] Foreign Application Priority Data

June 30, 1975 Japan ..... 50-80697
June 30, 1975 Japan ..... 50-80698

[51] Int. Cl.[2] ..... A01B 63/112
[52] U.S. Cl. ..... 172/9; 172/12
[58] Field of Search ..... 172/2, 4, 4.5, 7, 8, 172/9, 10, 11, 12; 171/9; 37/DIG. 1; 214/762; 404/84

[56] References Cited

U.S. PATENT DOCUMENTS

| | | | |
|---|---|---|---|
| 2,913,878 | 11/1959 | Rue | 172/4 X |
| 3,246,701 | 4/1966 | Schulz | 172/9 |
| 3,497,014 | 2/1970 | Ask | 172/7 |
| 3,658,133 | 4/1972 | Sweet et al. | 172/4 |
| 3,731,746 | 5/1973 | Walberg | 172/9 |
| 3,860,074 | 1/1975 | Maistrelli | 172/7 |
| 3,961,670 | 6/1976 | Rivinius | 172/4.5 |

FOREIGN PATENT DOCUMENTS

| | | | |
|---|---|---|---|
| 923,698 | 4/1973 | Canada | 172/4.5 |
| 2,508,620 | 8/1975 | Germany | 172/7 |

*Primary Examiner*—Richard T. Stouffer
*Attorney, Agent, or Firm*—Diller, Brown, Ramik & Wight

[57] ABSTRACT

The control system is provided with a detector that detects whether the ripper is operated in a piercing operating mode or a digging operating mode. In the piercing operating mode the angle of the shank is adjusted to a preset piercing angle, while in the digging operating mode the shank angle is adjusted to a preset digging angle thereby effecting optimum piercing and digging operations. Limit switches for detecting upper and lower limit positions of the shank are provided for raising and lowering the shank between these limit positions while adjusting the shank angle. Further an overload detector is provided for raising the shank when its load exceeds a predetermined load and lowering the shank when the load decreases below it. A manual preference control device also provided for enabling manual control during automatic control.

5 Claims, 7 Drawing Figures

50
56
102a
102c
T1
102
103
103a
102a1
102b1
B2
B1
T2
57
51
1
18
102c2
B0
52
58
43
42
102a2
T3
90d
102b2
90c
H1
90b
90
H2
90b1
90d1
48
44
45
59
90c1
19
20
35
34a
6a
65
5a
6
D2
D1
C2
C1
5
5b
34'
46
49
47
28
8
7
62
63
81
9
11
11a
11b
11d
10a
53
10c
11a1
F1
E1
10
11b1
10d
34
31
33
32
11c1
F2
E2
10c1
F3
10c2
E3
55
11a2
11b2
11c2
10b1
10b2
11d2
10a2
21e
21c
21f
21d
13
12
21
60
39
61
Q
S
21g
21a
21b
41
38d
40
16
16c
38
38c
29
30
16'
P
15
H
I
J
14
16a
16b
38b
38a
36
37
64
28
28
28
22d
22e
K
L
M
22b
22c
17
27
22a
24
26
25
23
28
64

AUTOMATIC CONTROL SYSTEMS FOR RIPPERS FOR USE IN CIVIL WORKS

BACKGROUND OF THE INVENTION

This invention relates to automatic control system of a ripper utilized in a civil work which can automatically move the ripper shank in the vertical direction and can control the shank angle to coincide with a preset piercing angle when operating in a piercing operation mode whereas to control the shank angle to coincide with a preset digging angle when operating in a digging operation mode.

Heretobefore, the digging operation by a ripper mounted on the rear end of a civil machine such as a tractor is manually controlled by an operator. Thus, the operator moves the ripper shank in the vertical direction and adjusts the shank angle by experience and by taking into consideration such factors as the ground condition, vehicle speed and other operating conditions. Accordingly, the operator is required to have a high skill and experience. In addition, in order to manually control the ripper shank, the operator must constantly watch the progress of the operation. This not only increases fatigue of the operator but also decreases efficiency of the operation.

SUMMARY OF THE INVENTION

Accordingly, it is an object of this invention to provide a novel control system for a ripper utilized in a civil machine which can eliminate various difficulties described above, can automatically move the ripper in the vertical direction, and can adjust the shank angle to any desired value while performing piercing and digging operations.

Another object of this invention to provide novel ripper shank control system capable of preferentially switching from automatic control to manual control.

Still another object of this invention is to provide an improved automatic control system for a ripper shank capable of automatically raising or lowering the ripper shank in accordance with the foreward or rearward running of a civil machine carrying the ripper.

According to this invention, these and other objects can be accomplished by providing an automatic control system for a ripper utilized in a civil work comprising first-detecting means that detects whether a ripper shank is working in a piercing operating mode or a digging operating mode; second detecting means for detecting a preset piercing angle and a preset digging angle of the shank of the ripper; third detecting means interlocked with a forward-reverse control lever for detecting the forward running position and rearward running position of the shift control lever; fourth detecting means for detecting a preset overload of the shank; fifth detecting means for detecting upper and lower limit positions of the shank; an electric control signal generating circuit responsive to the result of detection of the first to fifth detecting means for producing a first control signal for commanding the tilting and lifting of the shank, and a second control signal for commanding the extension, contraction and stop of a tilting cylinder and a lifting cylinder for the shank; a tilt-lift transfer control fluid pressure circuit including a first electromagnetic transfer valve actuated by the first control signal, and a lift-tilt transfer valve actuated by the electromagnetic transfer valve for supplying the operating fluid to the selected one of the tilting cylinder and the lifting cylinder; an operating fluid control circuit including a second electromagnetic transfer valve actuated by the second control signal, and a main transfer valve actuated by the operating fluid supplied by the second electromagnetic transfer valve for controlling the direction of flow of the operating fluid supplied to the tilting cylinder and the lifting cylinder; whereby during the forward running and in the piercing operating mode the shank is adjusted to the preset piercing angle and then lowered, whereas in the digging operation mode, the lowering of the shank is stopped, the shank is adjusted to the preset digging angle and then lowered, when the shank is overloaded while operating in the digging mode, the shank is raised and when the ripper is run in the rearward direction and in the digging operating mode the shank is raised, the raising and lowering of the shank being stopped at the upper and lower limit positions, respectively.

According to a modification of this invention there is provided an automatic control system for a ripper utilized in a civil work comprising a switch circuit for selecting and commanding the raising and lowering of the shank of the ripper when entering into a digging region from a piercing region and the raising and lowering of the shank when entering the piercing region from the digging region; first detecting means for detecting the fact that the shank is in the piercing region or in the digging region; second detecting means for detecting the fact that the shank angle is at a preset piercing angle or a preset digging angle; third detecting means for detecting an overload condition of the shank; fourth detecting means for detecting upper and lower limit positions of the shank; an electric control signal generating circuit for generating a first control signal for commanding the tilting and lifting of the shank in accordance with the outputs from the first to the fourth detecting means at the time of the lowering command and a second command signal which effects extension, contraction and stop of a tilting cylinder for the shank at the time of a tilting command, and effects the contraction of the tilting cylinder only at the time of overload and at the time of a lifting command; said electric control signal generating circuit generating the first control signal that commands the lifting and tilting of the shank in response to the outputs from respective detecting means at the time of the raising command, and generating the second control signal that commands the extension, contraction and stop of the tilting cylinder for the shank at the time of the tilting command, whereas commands the contraction and stop of the lifting cylinder at the time of the lift command; a tilt-lift transfer controlling fluid pressure circuit including a first electromagnetic transfer valve actuated by the first control signal, and a lift-tilt transfer valve actuated by the operating fluid supplied by the first electromagnetic transfer valve for supplying the operating fluid to the selected one of the lifting cylinder and the tilting cylinder; and a fluid pressure circuit for controlling the direction of flow of the operating fluid including a second electromagnetic transfer valve actuated by the second control signal, and a main transfer valve actuated by the operating fluid supplied by the second electromagnetic transfer valve for switching the direction of the operating fluid supplied to respective cylinders thereby selectively performing the lowering control and the raising control of the shank.

BRIEF DESCRIPTION OF THE DRAWINGS

Further objects and advantages of the invention can be more fully understood from the following detailed description taken in conjunction with the accompanying drawings in which.

DESCRIPTION OF THE PREFERRED EMBODIMENTS

Figure 1:
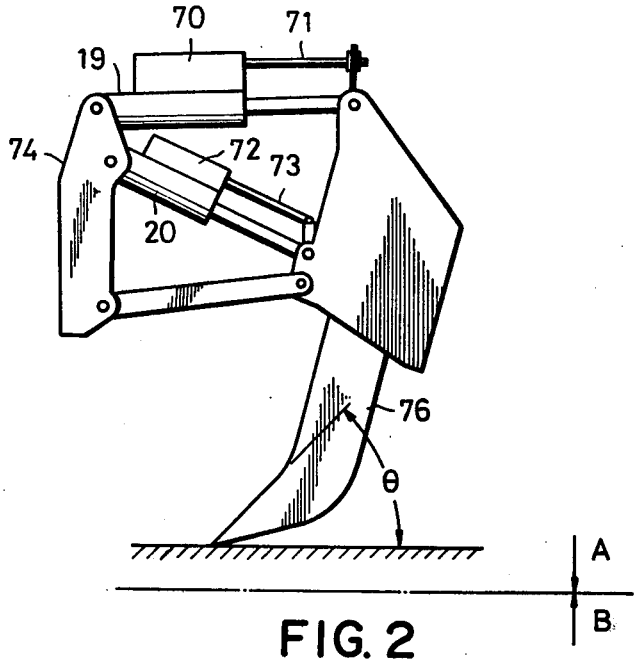
FIG. 1 is a side view of a hydraulic ripper apparatus.
Figure 3:
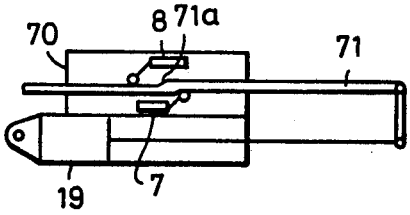
FIG. 3 is a partial view showing a piercing angle and a digging angle setting mechanism.

FIG. 1 shows the mechanical construction of a ripper. As shown, a rod 71 is operated by a tilting cylinder 19 to move in parallel relationship therewith. As shown in FIG. 3, the rod 71 is provided with an offset portion so as to operate a piercing angle set switch 8 (FIG. 3) and a digging angle set switch 7 which are secured to a bracket 70 mounted on the tilting cylinder 19.

Denoting the angle between the cutting edge of the shank 76 and the horizontal surface by $\theta$ (FIG. 1), the piercing set angle by $\alpha$, and the digging set angle by $\beta$, the opened and closed conditions of the switches 7 and 8 are shown in the following Table I.

Table I

| | $\theta > \alpha$ | $\alpha \geqq \theta \geqq \beta$ | $\theta < \beta$ |
|---|---|---|---|
| Switch 8 | open | close | close |
| Switch 7 | close | close | open |

Figure 2:
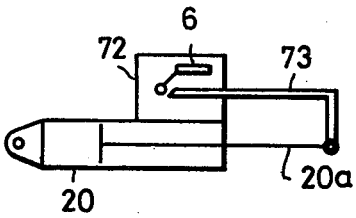
FIG. 2 is a partial view showing a mechanism for detecting a piercing operation mode, and a digging operation mode and utilized in the hydraulic ripper apparatus.

Although a piercing angle $\theta \approx 55°$ C, and a digging angle $\theta \approx 45°$ are preferred, these values may be varied according to the operating conditions. To this end, the mounting positions of the switches 7 and 8 are varied. The mode in which the cutting edge of the shank is in a region A as (FIG. 1) shown in FIG. 1 is termed a piercing operation mode, whereas the mode in which the cutting edge is in a region B is termed a digging operation mode for the purpose of providing different ripper controls as will be described later. To discriminate these modes, a switch 6 is mounted on the braket 72 to detect operating regions A and B. The switch 6 is arranged to be operated by a rod 73 connected to a piston rod 20*a* of a lifting cylinder 20 in parallel therewith. The condition shown in FIG. 2 shows region B. The condition wherein the piston rod 20*a* moves to the left and the free end of the rod 73 engages the actuating lever of switch 6 represents region A.

Figure 4:
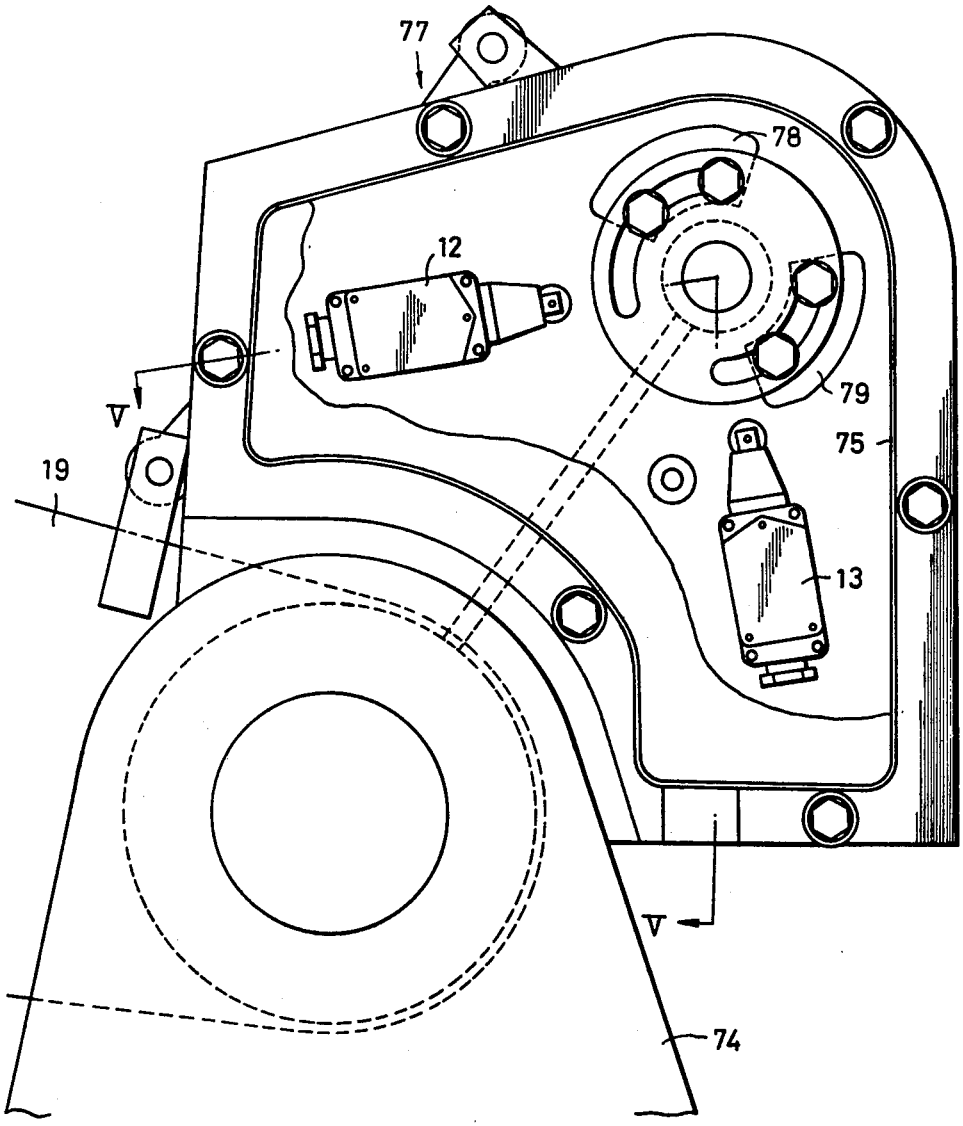
FIG. 4 is a side view showing upper and lower limit setters.
Figure 5:
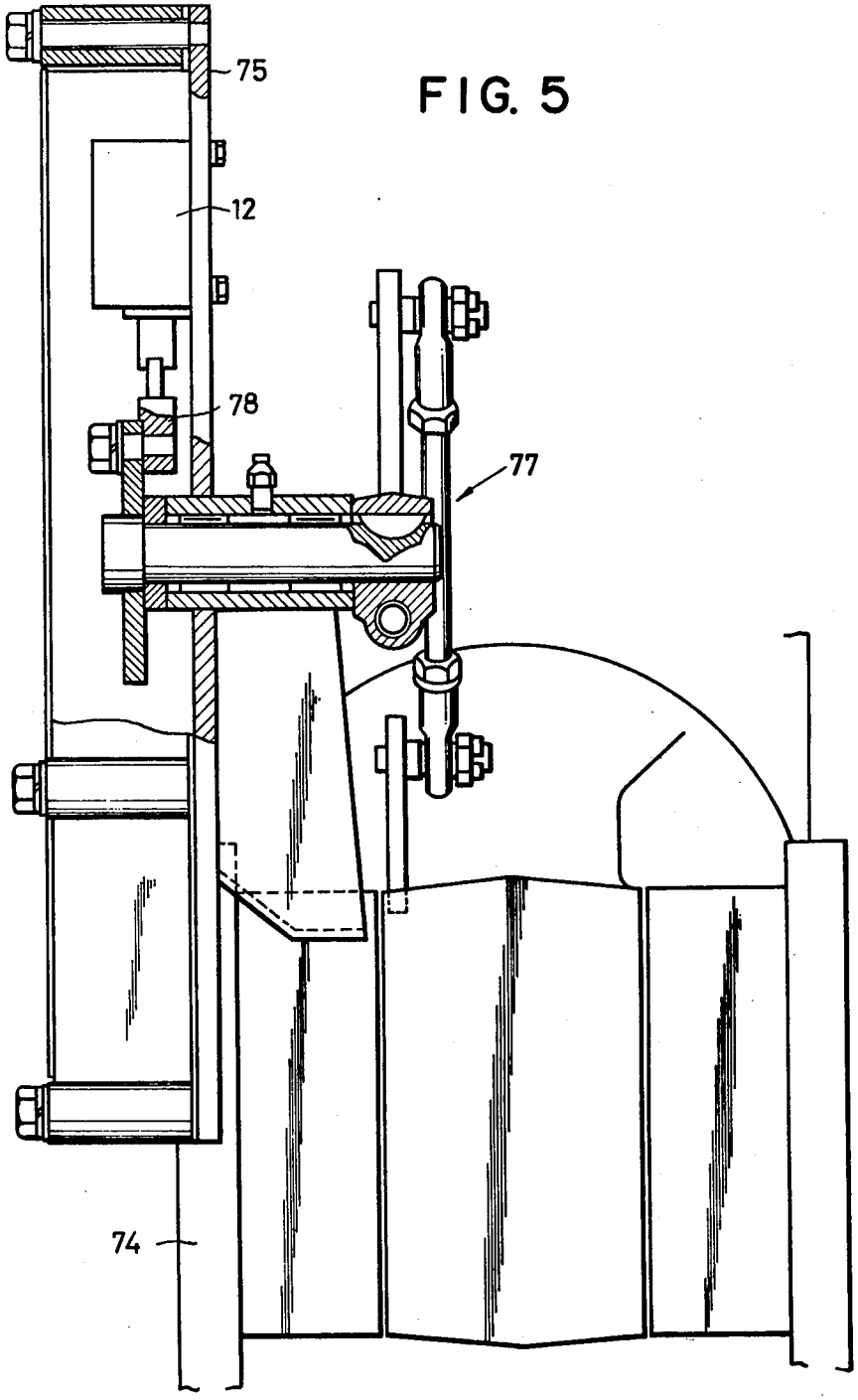
FIG. 5 is a sectional view taken along a line V—V in FIG. 4.

Cylinder 19 is pivotally connected to ripper bracket 74 so that the cylinder 19 swings as a shank 76 is moved in the vertical direction. By detecting the swinging motion, the upper limit position and the lower limit position of the shank 76 are set. Thus, as shown in FIGS. 4 and 5, the tilting cylinder 19 is connected through a linkage 77 with a cam plate (unnumbered) provided with two cams 78 and 79 which are arranged to engage a limit switch 12 for the lower limit and a limit switch 13 for the upper limit, respectively, for detecting the lower and upper limit positions.

Figure 6:
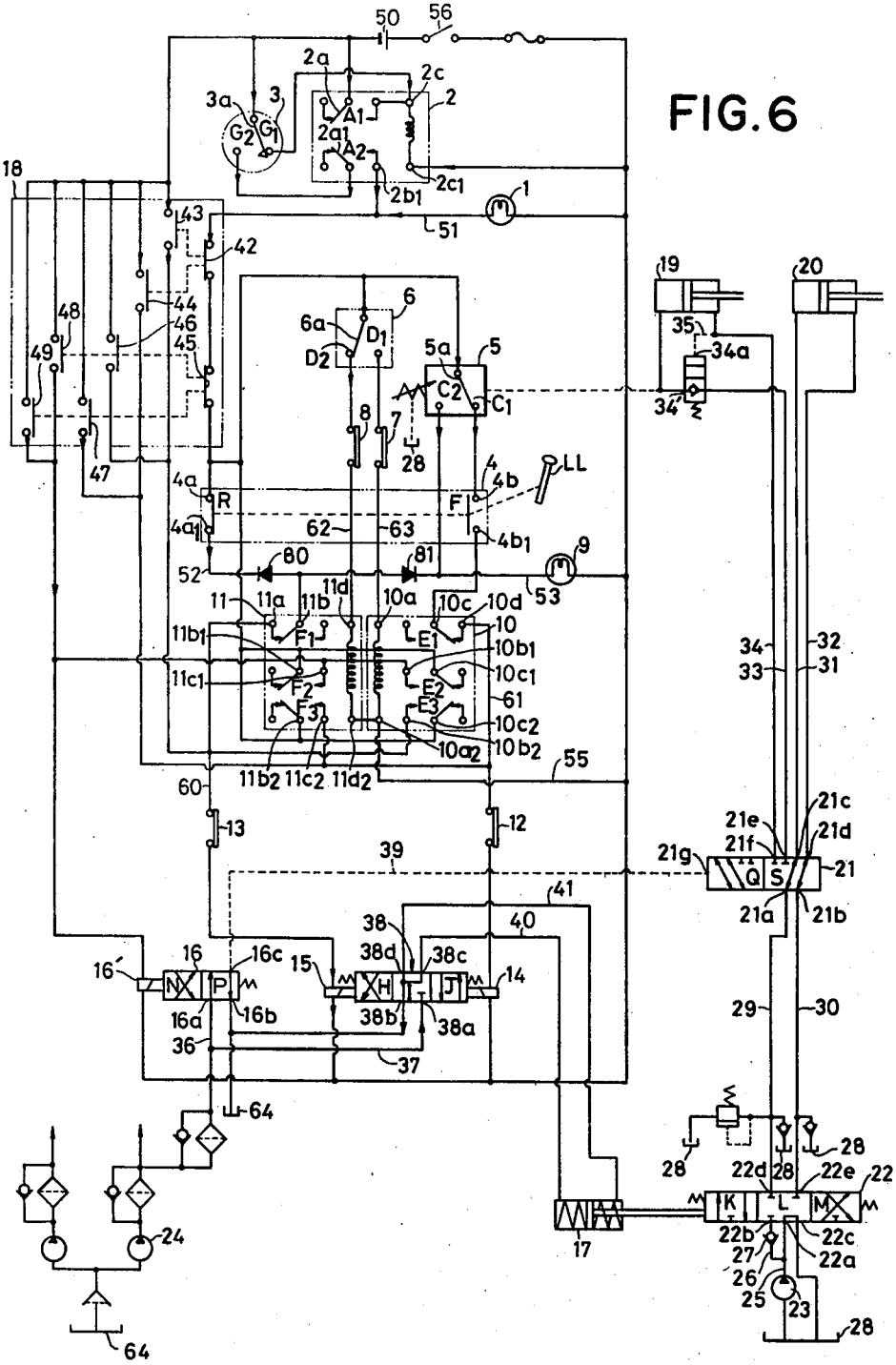
FIG. 6 is a diagram of one example of an electric and hydraulic control circuit of the novel ripper automatic control system embodying the invention.

FIG. 6 shows one example of an electrohydraulic control circuit for a ripper shank. As shown, a manual-automatic transfer switch 3 is provided with a movable switch 3*a* which is thrown to an automatic side contact $G_2$ for automatic operation whereas to a grounded manual side contact $G_1$ for manual operation. The transfer of the switch 3*a* to the automatic side should be made after a source switch 56 has been closed. However, for the purpose of preventing a false operation due to the closure of the source switch 56 after throwing the transfer switch 3 to the automatic side, there is provided a safety relay 2. Thus, when the source switch 56 is closed while the transfer switch 3 is engaging contact $G_1$, the coil (unnumbered) of the relay 2 is energized to move its movable contacts 2*a* and 2*a*$_1$ to the side opposite to that shown and the relay is self-held by contacts 2*a* and $A_1$. Thereafter, when the transfer switch 3 is thrown to the automatic side $G_2$, a circuit is closed to a conductor 51 through contact $G_2$ and contact 2*a*$_1$ and $G_2$ whereby a display lamp 1 is lighted to display an automatic operation.

A forward-reverse judging switch 4 is interlocked with a forward-reverse level LL. During the forward running, a contact piece opens contacts 4*a* and 4*a*$_1$ whereas a contact piece F closes contacts 4*b* and 4*b*$_1$. During the rearward running, contact piece R is closed and the contact piece F is opened. A pressure switch 5 for setting a load is constructed to close contact $C_2$ when the head side pressure in the tilting cylinder 19 reaches a predetermined set value, whereas to close contact $C_1$ when the pressure decreases below the set value, as shown in FIG. 6. A piercing-digging operation mode judging switch 6 is constructed to engage contact $D_2$ when the ripper operates in region A but engages contact $D_1$ in region B. A piercing angle setting switch 8 and a digging angle setting switch 7 connected in series with contacts $D_1$ and $D_2$ of switch 6 are normally held in the closed positions but opened when a preset piercing angle and a preset digging angle are reached respectively. A lamp 9 is connected to be lighted when the load imposed on the shank becomes excessive and the pressure switch 5 engages contact $C_2$, thus acting as a shank overload display lamp. A digging angle control relay 10 is provided for controlling the shank when the ripper operates in the digging mode or region B, and a piercing angle control relay 11 is provided for controlling the shank when the ripper operates in the piercing mode or region A. A lower limit set switch 12 and an upper limit set switch 13 are normally held in their closed positions but when the ripper reaches the lower limit position and the upper limit position respectively, the appropriate one of switches 12 and 13 are opened.

A three position electromagnetic transfer valve 38 has three positions H, I and J and solenoid coils 14 and 15. When solenoid coil 14 is energized the valve 38 is moved to position J, but when solenoid coil 15 is energized the valve 38 is moved to position H. When neither solenoid coil is energized, the valve 38 stays in the neutral position I. A two position electromagnetic transfer valve 16 has two positions N and P and a solenoid coil 16*d* and is moved to position N when the solenoid coil 16*d* is energized but to position P by a spring (unnumbered) when the solenoid coil 16*d* is deenergized. A ripper operating cylinder 17 is provided for the purpose of actuating a ripper operating valve 22. In the state shown in FIG. 6, the valve 22 is maintained at a neutral position L. However, when the piston rod of cylinder 17 moves to the right, the valve 22 is moved to position K whereas when the piston rod moves to the left, the valve is moved to position M.

A lift-tilt transfer valve 21 is controlled by the two position electromagnetic transfer valve 16 such that when valve 16 is at position N, valve 21 will be moved to position Q whereas when valve 16 is at position P the valve 21 will be moved to position S. Reference numeral 23 shows an oil pump for operating the civil machine and 24 a transmission pump.

The port 22*a* of the ripper operating valve 22 is connected to the discharge side of the pump 23 via a conduit 25 and a branch 26 of conduit 25 is connected to a port 22*b* of the valve 22 via check valve 27. A port 22*c* of the valve 22 is connected to a reservoir 28. Ports 22*d* and 22*e* are connected to ports 21*a* and 21*b* of the lift-tilt transfer valve 21 via conduits 29 and 30, respectively. Ports 21*c* and 21*d* of the lift-tilt transfer valve 21 are connected to the head side and the rod side of the lift cylinder 20 via conduits 31 and 32 respectively. Ports 21*e* and 21*f* of the lift-tilt transfer valve 21 are connected to the head side and the rod side of the tilting cylinder 19 via conduits 33 and 34 respectively and a transfer valve 34' is connected in the conduit 33. A pressure receiving member 34*a* of this transfer valve 34' is connected to the rod side of the tilting cylinder 19 via conduit 35, while the head side of the tilting cylinder 19 is connected to pressure receiving port 5*b* of the load setting pressure switch 5.

The discharge side of the transmission pump 24 is connected to a port 16*a* of the two position electromagnetic transfer valve 16 via conduit 36 and to a port 38*a* of the three position electromagnetic transfer valve 38 via conduit 37. The ports 16*a* and 38*b* of the two position electromagnetic transfer valve 16 and the three position electromagnetic transfer valve 38 respectively are connected to a reservoir 64. A port 16*c* of the two position electromagnetic transfer valve 16 is connected to a pressure receiving port 21*g* of the lift-tilt transfer valve 21 via a conduit 39. The ports 38*c* and 38*d* of the three position electromagnetic transfer valve 38 are connected to the head side and the rod side respectively of the ripper operating cylinder 17 via conduits 40 and 41 respectively.

A ripper manual operation switch circuit 18 comprises an automatic circuit interrupting switch 42, raise and lower switches 43 and 44 interlocked with switch 42, an automatic circuit interrupting switch 45, a tilt switches 46 and 48 and tilt back switches 47 and 49 interlocked with the switch 45. One terminal of each of the switches 43, 44, 46, 47 48 and 49 of the ripper manual operating switch circuit 18 is connected to one terminal of a source 50. The movable contact piece 3*a* of the manual-automatic transfer switch 3, and the movable contact piece 2*a* of the safety relay 2 are also connected to the same terminal of the source 50. The automatic side contact $G_2$ of the manual-automatic transfer switch 3 is connected to the movable contact piece $2_{al}$ of the safety relay 2, whereas the manual side contact $G_1$ of the manual-automatic transfer switch 3 is connected to the terminal 2*c* of the safety relay 2. The other or positive terminal of the source 50 is connected to a terminal $2_{c1}$ of the safety relay 2 and to the terminal $2_{b1}$ connected to a stationary contact $A_2$ of the safety relay 2 via display lamp 1 and conductor 51.

Contact $C_2$ of the load setting pressure switch 5 is connected to the positive side of the source 50 via the load display lamp 9 and a conductor 53. Contact $10_{a2}$ of the digging angle control 10 and a contact $11_{d2}$ of the piercing angle control relay 11 are also connected to the positive terminal of the source 50 via a conductor 55. One terminal of each of the solenoid coils 14 and 15 of the three position electromagnetic transfer valve 38 and one terminal of the solenoid coil of the two position electromagnetic transfer valve 16 are also connected to the positive terminal of the source 50. The other terminal of the solenoid coil 16*d* of the two position electromagnetic transfer valve is connected to the other terminals of the switches 48 and 49 of the ripper manual operating switch circuit 18. The other terminal of the solenoid coil 15 is connected to a contact 11*a* of switch F1 of the piercing angle control relay 11 through an upper limit setting switch 13 and a conductor 60. Furthermore, the other terminal of a solenoid coil 14 is connected to the contact 10*d* of a switch $E_1$ of the digging angle control relay 10 through conductor 61 and the lower limit setting switch 12. The upper contact of this switch is connected to a contact $11_{c2}$ of the switch $F_3$ of the piercing angle control relay 11, to the lowering switch 44 of the ripper manual operating switch circuit 18 and to the lower contact of the tilt back switch 47. The upper terminal of the upper limit setting switch 13 is connected to the lower terminal of the raising switch 43 of the ripper manual operating switch circuit 18 and to a contact $10_{b2}$ of the switch $E_3$ of the digging angle control relay 10.

The lower terminal of the switch 45 of the ripper manual operating switch circuit 18 is connected to the upper contact 4*a* of the rearward switch R of the forward-rearward judging switch 4 and to the switch $F_2$, contacts $11_{b1}$ and $11_{b2}$ of the piercing angle control relay 11, and to the movable contacts $11_{c1}$ and $11_{c2}$ of the switches of the digging angle control relay 10. The lower contact of switch 45 is connected to the movable contact 6*a* of the piercing-digging operation mode judging switch 6 and to the movable contact 5*a* of the load setting pressure switch 5.

The upper terminal of the solenoid coil 16*d* of the two position electromagnetic transfer valve 16 is connected to the contact $11_{c1}$ of the switch $F_2$ of the piercing angle control relay 11 and to the contact $10_{b1}$ of the switch $E_2$ of the digging angle control relay 10.

The movable contact 11*b* of the switch $F_1$ of the piercing angle control relay 11 is connected to the contact 4*a* of the reverse contact R of the forward-reverse judging switch 4 via a diode 80 and to the contact $C_2$ of the load setting pressure switch 5 via a diode 81. The contact 11*d* of the piercing angle control relay 11 is connected to the contact $D_2$ of the piercing-digging operating mode judging switch 6 via a conductor 62 and the piercing angle setting switch 8. The contact 10*a* of the digging angle control relay 10 is connected to the contact $D_2$ of the piercing-digging operating mode judging switch 6 via conductor 63 and a digging angle setting switch 7.

The movable contact 10*c* of the switch $E_1$ of the digging angle control relay 10 is connected to the contact $4_{b1}$ of the forward contact F of the forward-rearward judging switch 4, while the contact 4*b* of the forward contact F is connected to the contact $c_1$ of the load setting pressure switch 5.

The upper terminal of the switch 42 of the manual operating switch circuit 18 is connected to the contact $2_{b1}$ of switch $A_2$ of the safety relay 2 whereas the lower terminal of the switch 42 is connected to the upper terminal of switch 45.

The control operation of the hydraulic ripper will now be described with reference to FIG. 6.

Various switches and contacts are shown in a condition where the source switch 56 is not yet closed and hence the solenoid coils of electromagnetic transfer valves 16 and 38 are not energized. The piercing-digging operation mode judging switch 6 is shown in the piercing operation mode that is region A. Thus, as will be described later, the ripper is raised to the upper limit position and held standstill at that position.

The automatic control operation of the ripper will be started by closing the source switch 56 and then moving the movable contact 3*a* of the manual-automatic transfer switch 3 to contact $G_2$ from contact $G_1$.

Before describing in detail the operation of the control system, the outline thereof will firstly be described. Table II below shows the operation conditions of the tilting cylinder 19 and the lifting cylinder 20 by the combinations of the respective positions of the electromagnetic transfer valve 16, the tilt-lift transfer valve 21, the electromagnetic transfer valve 38, and the ripper operating valve 22. As shown there are four operating modes $OP_1$ through $OP_4$ Table II

| | valve 16 | valve 21 | valve 38 | valve 22 | tilting cylinder 19 | lifting cylinder 20 |
|---|---|---|---|---|---|---|
| $OP_1$ | N | Q | J | K | contract | No. |
| $OP_2$ | N | Q | H | M | extend (tilt) | No. |
| $OP_3$ | P | S | J | K | No | extend (shank lower) |
| $OP_4$ | P | S | H | M | No | contract (shank raise) |

The term "tilt back" means the movement of the shank 76 in the counterclockwise direction and the term "tilt" the movement in the clockwise direction.

Assume now that the shank 76 is in the piercing operation mode, that is region A, that the forward-reverse control lever LL is at the forward position, and that the shank angle $\theta$ is smaller than a preset piercing angle, then when the shank 76 is tilted back (operation mode $OP_1$) to a preset piercing angle, for example 55°, the tilt back motion is ceased. Then, the shank is lowered (operation mode $OP_3$) Consequently, as soon as the shank 76 assumes the digging operation mode, that is, enters into region B, the lowering movement is stopped and when the shank 76 is tilted (operation mode $OP_2$) to a preset digging angle, for example 45°, the tilting operation is stopped. Then the shank 76 of the ripper will be lowered (operation mode $OP_3$). Although this lowering motion is stopped when the lower limit set position is reached, when the load becomes excessive during lowering, the shank 76 will be raised (operation mode $OP_4$).

During the rearward running, if the angle $\theta$ of shank 76 is larger than the preset digging angle, the shank 76 will be tilted (operation mode $OP_2$) and when a preset digging angle is reached, the tilting operation will be stopped. Then, the shank 76 is raised (operation mode $OP_4$). As soon as the piercing region A is reached, the raising operation is stopped and the shank 76 is tilted back (operation mode $OP_1$). As the angle $\theta$ of the shank 76 reaches the preset piercing angle, the tilt back is stopped. Then the shank is immediately raised (operation mode $OP_4$) and when it reaches the upper limit position the raising operation is stopped.

The operation will now be described in detail.

After closing the source switch 56 when the manual-automatic transfer switch 3 is thrown to automatic side contact $G_2$ the coil of the piercing angle control relay 11 is energized provided that the height of the ripper shank 76 ensures the piercing operation region A (a case wherein the piercing-digging operation mode judging switch 6 assumes position $D_2$). Then current flows through a circuit including source 50, solenoid coil 14, switch 12, contacts 11, $C_2$ and $11b_e$ and switches 45 and 42 thus energizing the lowering solenoid coil 14 of the electromagnetic transfer valve 38. As a result, the valve 38 is switched to position J and the ripper operating valve 22 is switched to position K by the ripper operating cylinder 17. At the same time, current flows through a circuit including source 50, solenoid coil 16*d*, contacts $11_{c1}$ and $11_{b1}$, and switches 45 and 42 to energize the solenoid coil 16*d* so that the electromagnetic valve 16 is switched to position N. Consequently, a pilot pressure acts upon the lift-tilt transfer valve 21 via conduit 39 so that valve 21 is switched to positioned Q to operate the tilting cylinder 19, thus tilting back the ripper shank 76 (cylinder contracts) (operation mode $OP_1$). This tilting back is continued until the piercing angle setting switch 8 opens, that is, an optimum piercing angle is reached.

The piercing angle setting switch 8 is maintained in the closed position until the tilting cylinder 19 contracts to bring its offset portion 71*a* against switch 8. However, switch 8 is opened when the offset portion 71*a* has passed by.

The movable contact 6*a* of the piercing-digging mode judging switch 6 engages $D_2$ so long as it engages rod 73 interlocked with piston rod 20*a* of the lifting cylinder 20, but engages contact $D_1$ when the switch 6 disengages rod 73.

When the piercing angle setting switch 8 is opened, the coil of the piercing angle control relay 11 is deenergized to disengage contacts $11b_1$ 11*c* of switch $F_2$ so that the solenoid coil 16*d* of the transfer valve 16 is deenergized thus moving the electromagnetic transfer valve 16 to position P. Accordingly, the lift-tilt transfer valve 21 is switched to positions for operating lifting cylinder 20. Since the forward-reverse control lever LL, is held in the forward position and since the F contact of the forward-rearward judging switch 4 is closed and its contact R is opened, a circuit including switch 12, contacts 10*d* and 10*c*, and the forward contact is established so that the solenoid coil 14 is energized to move the electromagnetic transfer valve 38 to position J. As a consequence, valve 22 is moved to position *k* and the ripper shank 76 begins to descend. (Operation mode $OP_3$).

When the ripper shank 76 enters into the digging operation region B, in other words, as the piercing-digging operation mode switch 6 transfers to position $D_1$, the coil of the digging angle control relay 10 is energized so that switches $E_1$, $E_2$ and $E_3$ are transferred to the positions opposite to those shown. As a consequence, the connection between contacts 10*d* and 10*c* is interrupted thus deenergizing solenoid coil 24. Further, the transfer operation of switch $E_2$ interconnects contacts $10b_1$ and $10c_1$ so that the solenoid coil 16*d* is energized to move the two position electromagnetic transfer valve 16 to position N, thereby moving the lift-tilt transfer valve 21 to position Q. At the same time, by the transfer operation of switch $E_3$, contacts $10b_2$ and $10_{c2}$ are interconnected so that solenoid coil 15 is energized to move the electromagnetic transfer valve 38 to position H. As a result, the ripper operating cylinder 17 contracts and the valve 22 is moved to position M. Accordingly, the lowering motion of the shank 76 is stopped and the tilting cylinder immediately extends to tilt the shank 76, (operation mode $OP_2$). This tilting operation continues until the digging angle setting switch 47 opens.

Upon opening the digging angle switch 7, the digging angle control relay 10 is deenergized to transfer switches $E_1$, $E_2$ and $E_3$ to the positions shown in FIG. 6. The transfer of switch $E_2$ separates contacts $10b_1$ and $10c_1$ to deenergize solenoid coil 16*d* of the electromagnetic transfer valve 16 thus returning the same to position P. Accordingly, the lift-tilt transfer valve 21 assumes position S. At the same time contacts $10b_2$ and $10c_2$ are separated by the transfer of switch $E_3$ to deenergize solenoid coil 15, and the contacts 10*d* and 10*c* are interconnected by switch $E_1$ to energize solenoid coil 14. Thus, the electromagnetic transfer valve 38 is moved to position J to bring valve 22 via cylinder 17. As a result, the lift cylinder 20 extends to lower again the ripper shank 76 (operation mode $OP_3$).

While the ripper shank 76 is digging soil or rock in the lowered position, when the load on the ripper shank 76 increases so that the pressure acting upon the head side of the tilting cylinder 19 exceeds the preset pressure of the load pressure setting switch 5, the movable contact of the switch 5 is thrown to contact $C_2$.

Then, the overload display lamp 9 is lighted and as a circuit extending through solenoid coil 15, switch 13, contacts 11*a* and 11*b*, diode 81, pressure switch 5, switches 45 and 42, contacts $2b_1$ and $2a_1$, and manual-automatic transfer switch 3 is established across the source 50, solenoid coil 15 is energized thus switching the electromagnetic valve 38 to position H. Consequently, the valve 22 is switched to position M. At this time, however, as the positions of the electromagnetic valve 16 and the lift-tilt transfer valve 21 are not altered, the ripper shank 76 is raised (operation mode $OP_4$). As the shank 76 rises, the load thereon decreases and when the oil pressure acting upon the head of the tilting cylinder 19 becomes lower than the set pressure of the load setting pressure switch 5, the pressure switch 5 closes contact $C_1$ thus moving the electromagnetic transfer valve 38 to position J whereby the shank 76 is lowered. This operation is automatically repeated during the digging operation of the ripper.

When the ripper shank 76 reaches the optimum digging angle, the digging angle setting switch 7 is opened to deenergize the coil of the digging angle control relay 10 thus switching the electromagnetic transfer valve 16 to position P and switching the lift-tilt transfer valve 21 to position S. Furthermore the electromagnetic transfer valve 38 actuates the ripper operating cylinder 17 and the ripper operating valve 22 is switched to position M to operate the lift cylinder 20 thus raising the ripper shank 76 (operation mode $OP_4$).

As the ripper shank 76 is raised to enter into the piercing operation region A from the digging operation region $B_1$, that is, when the piercing-digging operation mode judging switch 6 assumes position $D_2$, the coil of the piercing angle control relay 11 is energized to close the circuit for the solenoid coil 14 of the electromagnetic transfer valve 38 and the solenoid coil 16*d* of the electromagnetic transfer valve 16 so that the ripper shank 76 is tilted back until the piercing angle setting switch 8 opens (operation mode $OP_1$).

When the piercing angle setting switch 8 opens, the piercing angle control relay 11 is deenergized to close its switch $F_1$ as shown in the drawing thereby raising again the ripper shank 76 (operation mode $OP_4$).

As the ripper shank 76 is raised and the upper limit setting switch 13 is opened, the ripper shank 76 is stopped at that position.

Where it is desired to manually operate the ripper shank 76 during the automatic control thereof the automatic circuit interrupting switch 42 of the ripper manual operating circuit 18 and switch 15 are operated to open the automatic operation circuit, and switches 43 and 44 interlocked with switch 42 and switches 46, 48, 47 and 49 interlocked with switch 45 are operated so as to enable the ripper shank 76 to be manually operated.

The above description shows one example of a series of automatic operations performed during the forward running including the tilting back operation of the shank to the preset piercing angle in the piercing operation mode, the lowering operation after such setting, the tilting operation of the shank to the preset digging angle in the digging operation mode, the raising operation of the shank at the time of an overload, the lowering operation of the shank to the lower limit position, and the raising operation of the shank to the upper limit position. During the rearward running the operations are performed in the same manner as above described.

However, it is often desirable to perform the raising or lowering control in accordance with the operating mode regardless of whether the shift control lever is at the forward or rearward position.

Figure 7:
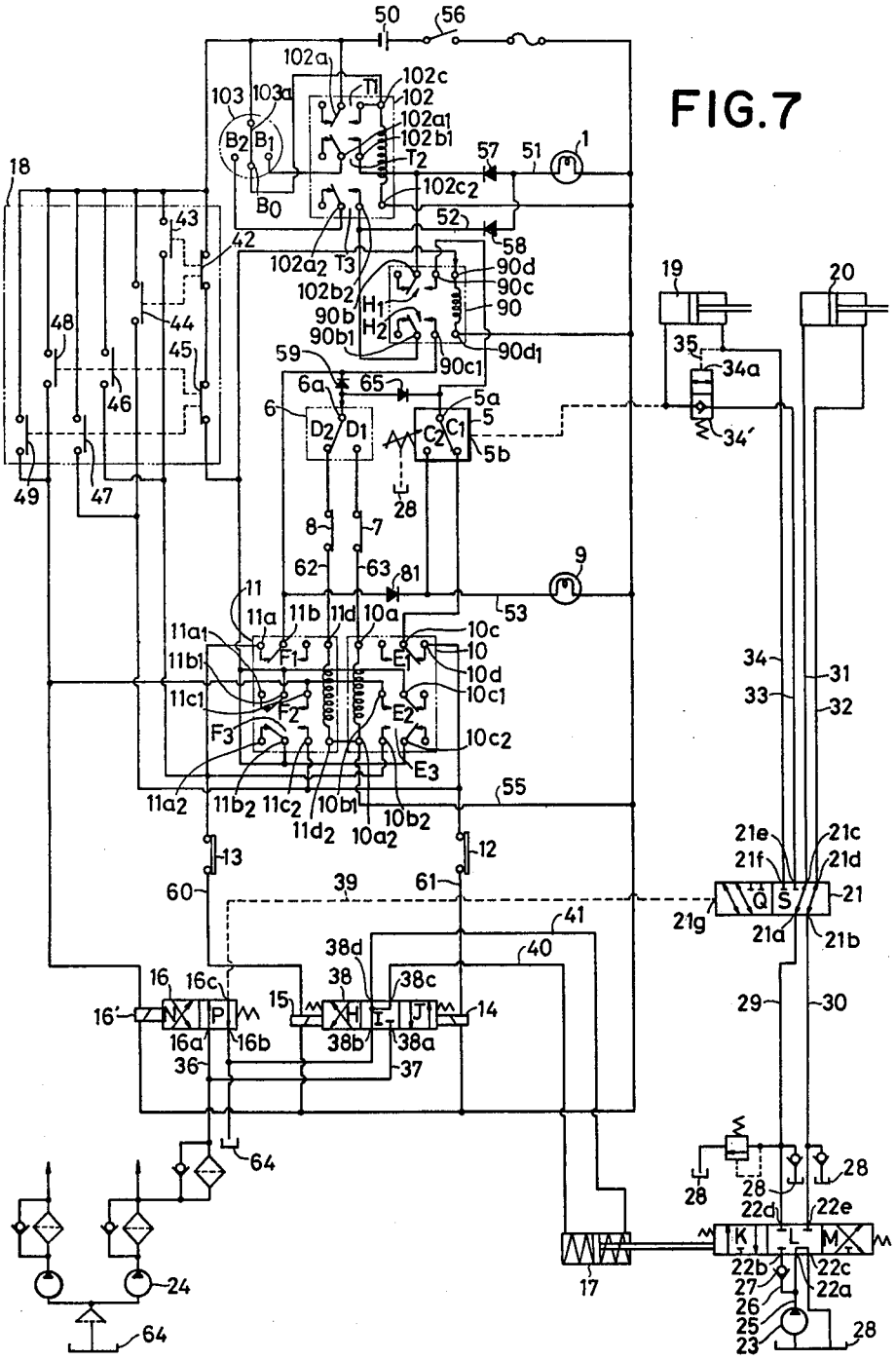
FIG. 7 is a diagram showing a modified control system.

FIG. 7 illustrates a modified embodiment of this invention capable of selectively performing the raising and lowering operations by the transfer operation of a switch.

The embodiment shown in FIG. 7 is different from the previous embodiment in that a manual-automatic transfer switch 103 is provided with three transfer contacts $B_1$, $B_2$ and $B_0$, that the safety relay 102 is provided with an additional switch $T_3$, that a manual preference relay 90 is provided and that forward-rearward judging switch 4 is not used.

More particularly, the contact $B_1$ of the manual-automatic transfer switch 103 is connected to a contact $102_{a1}$ of the safety relay 102, contact $B_0$ is connected to contact $102_c$ of the safety relay and contact $B_2$ is connected to contact $102a_2$. The movable contact 103*a* of the manual-automatic transfer switch 103 is connected to the negative terminal of the source 50. A movable contact 102*a* of the safety relay 102 is also connected to the negative terminal of the source 50. A contact $102b_1$ of the safety relay is connected to one terminal of lamp 1 via a diode 57 while a terminal $102b_2$ is connected to the same terminal of the lamp 1 via a diode 58. A terminal $102b_1$ is connected to the contact 90*b* of a switch $H_1$ of a manual preference relay 90, whereas a contact $102b_2$ is connected to a contact $90b_1$ of a switch $H_2$ of the manual preference relay 90. A lower terminal $90d_1$ of the coil of the relay 90 is connected to the positive terminal of a source 50 while the upper terminal 90*d* is connected to the negative terminal of the source 50 via switches 45 and 42. The terminal 5*a* of the load setting pressure switch 5 is connected directly to a terminal 90*c* of the relay 90.

The terminal 6*a* of the piercing-digging operation mode judging switch 6 is connected to the terminal $90c_1$ of the relay 90 via a diode 59, poled oppositely to diodes 57 and 58, and to the terminal 90*c* of the relay 90 via a diode 65 having the same polarity as diode 59. The terminal 11*b* of the piercing angle control relay 11 is connected to the terminal 90*c* of the relay 90. The terminal 10*c* of the digging angle control relay 10 is connected directly to the terminal $C_1$ of the load setting pressure switch 5. The other construction is identical to that of the first embodiment.

When the source switch 56 is closed while the movable contact 103*a* of the manual-automatic transfer switch 103 is engaging contact $B_0$, the coil of the safety relay 102 is energized thus moving switches $T_1$ and $T_2$ to the position opposite to the positions indicated in FIG. 7. At the same time, the coil of the manual preferences relay 90 is energized to move its switches $H_1$ and $H_2$ to the positions opposite to those indicated. Thereafter, when the manual-automatic transfer switch 103 is thrown to contact $B_1$ for lowering the shank, lamp 1 for displaying the automatic operation is lighted by a circuit extending between the opposite terminals of the source 50 through lamp 1, diode 57, switch $T_2$, and the manual-automatic transfer switch 103. Since terminal 90*b* and 90*c* are connected together the terminal 5*a* of the load setting pressure switch 5 is connected to the negative terminal of the source through switches $H_1$ and $T_2$ and through the manual automatic transfer switch 103, whereas the terminal 6*a* of the piercing-digging operation mode judging switch 6 is connected to the negative terminal of the source through diode 65, switches $H_1$, $T_2$ and the manual-automatic transfer switch 103. Accordingly, the lowering control is automatically performed in the same manner as in the first embodiment.

To perform the raising operation, the manual automatic transfer switch 103 is thrown to contact $B_2$. Then the terminal 6*a* of the piercing-digging operation mode judging switch 6 is connected to the negative terminal of the source 50 via diode 59, contacts $90c_1$ and $90b_1$ of the manual preference relay 90, contacts $102b_2$ and 102*a* of safety relay 102 and the transfer switch 103. The terminal 5*a* of the load setting pressure switch 5 is not connected to the negative terminal of the source because the manual-automatic transfer switch 103 is thrown to contact $B_2$. Accordingly, current does not flow through the contact $E_1$ of the digging angle control relay 10, thus preventing operation mode $OP_4$. Thus, the raising control is performed in the same manner as in the first embodiment.

Where it is desired to perform a manual operation during the automatic control of the raising and lowering operations, the automatic circuit interrupting switch 42 or 45 is opened to energize the coil of relay 90 thus moving switches $H_1$ and $H_2$ to the positions shown in FIG. 7. Accordingly, the automatic control is not possible and the manual control is performed by suitably operating switches 42 through 49 of the manual operating switch circuit 19.

While the invention has been shown and described in terms of certain preferred embodiments it will be clear that many changes and modifications will be obvious to one skilled in the art without departing from the true spriit and scope of the invention as defined in the appended claims.

What is claimed is:

1. An automatic control system for a ripper utilized in a civil work comprising first detecting means for detecting whether a ripper shank is working in a piercing operating mode or a digging operating mode; second detecting means for detecting a preset piercing angle and a preset digging angle of the shank of the ripper; third detecting means interlocked with a forward-reverse control lever for detecting the forward running position and the rearward running position of the shift control lever; fourth detecting means for detecting a preset overload of the shank; fifth detecting means for detecting upper and lower limit positions of the shank; an electric control signal generating circuit responsive to the result of detections of said first to fifth detecting means for producing a first control signal for commanding the tilting and lifting of said shank, and a second control signal for commanding the extension, contraction and stop of a tilting cylinder and lifting cylinder for said shank; a tilt-lift transfer control fluid pressure circuit including a first electromagnetic transfer valve actuated by said first control signal, and a lift-tilt transfer valve actuated by the operating fluid supplied by said electromagnetic transfer valve for supplying the operating fluid to the selected one of said tilting cylinder and said lifting cylinder; an operating fluid control circuit including a second electromagnetic transfer valve actuated by said second control signal, and a main transfer valve actuated by the operating fluid supplied by said second electromagnetic transfer valve for controlling the direction of flow of the operating fluid supplied to said tilting cylinder and said lifting cylinder; whereby during the forward running and in the piercing operating mode the shank is adjusted to said preset piercing angle and then lowered, whereas in the digging operation mode, the lowering of the shank is stopped, the shank is adjusted to said preset digging angle and then lowered, when the shank is overloaded while operating in the digging mode the shank is raised and when the ripper is run in the rearward direction and in the digging operating mode the shank is raised, the raising and lowering of said shank being stopped at said upper and lower limit positions respectively.

2. The automatic control system according to claim 1 which further comprises a circuit for preventing said electric control signal generating circuit from generating control signals at the time of manual operation, a manually operated switch circuit including a plurality of manually operated switches for selectively applying a manual control signal to the solenoid coils of said electromagnetic transfer valves.

3. The automatic control system according to claim 1 wherein said electric control signal generating circuit comprises a piercing operation mode control relay circuit for producing first and second control signals for controlling the tilting raising and lowering operations of the shank in the piercing operation mode, and a digging operation mode control relay circuit for generating first and second control signals for controlling the tilting, raising and lowering operations of said shank in the digging operation mode.

4. An automatic control system for a ripper utilized in a civil work comprising a switch circuit for selecting and commanding the raising and lowering of the shank of the ripper when entering into a digging region from a piercing region and the raising and lowering of the shank when entering into the piercing region from the digging region; first detecting means for detecting the fact that the shank is in the piercing region or in the digging region; second detecting means for detecting the fact that the shank angle is at a preset piercing angle or a preset digging angle; third detecting means for detecting an overload condition of the shank; fourth detecting means for detecting upper and lower limit positions of the shank; an electric control signal generating circuit for generating a first control signal for commanding the tilting and lifting of said shank in accordance with the output from said first to fourth detecting means at the time of said lowering command, and a second command signal which effects extension, contraction and stop of a tilting cylinder for the shank at the time of a tilting command, and effects the contraction of said tilting cylinder only at the time of overload and at the time of a lifting command; said electric control signal generating circuit generating said first control signal that commands the lifting and tilting of said shank in response to the output from respective detecting means at the time of said raising command, and generating said second control signal that commands the extension, contraction and stop of the tilting cylinder for said shank at the time of said tilting command, and commands the contraction and stop of said lifting cylinder at the time of the lift command; a tilt-lift transfer controlling fluid pressure circuit including a first electromagnetic transfer valve actuated by said first control signal, and a lift-tilt transfer valve actuated by the operating fluid supplied by said first electromagnetic transfer valve for supplying the operating fluid to the selected one of said lifting cylinder and said tilting cylinder; and a fluid pressure circuit for controlling the direction of flow of the operating fluid including a second electromagnetic transfer valve actuated by said second control signal, and a main transfer valve actuated by the operating fluid supplied by said second electromagnetic transfer valve for switching the direction of the operating fluid supplied to respective cylinders thereby selectively performing the lowering control and the raising control of said shank.

5. The automatic control system according to claim 4 which further comprises a manual preference control relay circuit for preventing said electric control signal generating circuit from generating said first and second control signals at the time of manual operation, and a manually operated switch circuit for selectively applying a manual control signal to the solenoid coils of said first and second electromagnetic transfer valves.

* * * * *